United States Patent [19]

Prost et al.

[11] 3,986,338

[45] Oct. 19, 1976

[54] METHOD AND APPARATUS FOR GENERATING LOW TEMPERATURES

[75] Inventors: Roger Prost, Saint Egreve; Jacques Broche, Echirolles, both of France

[73] Assignee: L'Air Liquide, Societe Anonyme pour l'Etude et l'Exploitation des Procedes Georges Claude, Paris, France

[22] Filed: Dec. 19, 1975

[21] Appl. No.: 642,614

[30] Foreign Application Priority Data

Dec. 26, 1974 France ..... 74.42815

[52] U.S. Cl. ..... 62/6

[51] Int. Cl.[2] ..... F25B 9/00

[58] Field of Search ..... 62/6

[56] References Cited

UNITED STATES PATENTS

| | | | |
|---|---|---|---|
| 3,318,100 | 5/1967 | Reinhoudt et al. | 62/6 |
| 3,788,088 | 1/1974 | Dehne | 62/6 |
| 3,812,682 | 5/1974 | Johnson | 62/6 |
| 3,834,172 | 9/1974 | Dehne | 62/6 |

*Primary Examiner*—Lloyd L. King

*Attorney, Agent, or Firm*—Young & Thompson

[57] ABSTRACT

A method and apparatus for generating low temperatures, of the type which employs two regenerators whose hot ends are connected via changeover valves alternately to the input and output of a compressor and cooler assembly and whose cold ends are connected by a constricted passage which form a cold source. In accordance with the invention, the changeover valves are controlled by means which are subject to a reference pressure.

9 Claims, 4 Drawing Figures

METHOD AND APPARATUS FOR GENERATING LOW TEMPERATURES

BACKGROUND OF THE INVENTION

The present invention relates to a method of generating low temperatures, which method involves the use of a composite gaseous charge which is made up of gases such as hydrocarbons and nitrogen having graduated condensation temperatures, the charge being placed in a closed circuit which includes a pair of thermal generators which are connected at cold ends by a passage containing a restricted opening and which are connected at hot ends to a compressor and cooler assembly via changeover valves, in which method the changeover valves are operated cyclically in such a way that, periodically, the gases forming the said composite gaseous charge can be extracted from one regenerator and fed into the other regenerator and then the reverse can be done. In this way, the infed gases are caused to undergo fractionated condensation in cascade in the regenerator which receives them. The condensation is a graduated one progressing from the hot end to the cold end of the regenerator and it successively involves gases having increasingly low condensation temperatures. A proportion of the gases, termed the residual proportion, which will not condense at the coldest temperature in the said regenerator tends to escape through the restricted passage and into the other regenerator, which is at low pressure. Gas is extracted from the other regenerator at the hot end and this results in fractionated evaporation of the gases which have previously been condensed in the said other regenerator. The evaporation of the gases naturally cools the regenerators and condensing them has the reverse effect, but the fall in the temperature of the regenerators is brought about by cooling the gaseous charge, which is done at the outlet from the compressor at ambient temperature or slightly below, and the very low temperature which is reached at the cold ends of the regenerators, and particularly at the point where the restricted pasage connecting them is situated, results from the setting up of a temperature gradient between the hot and cold ends of the regenerators, which is achieved by the use of a composite gaseous charge as defined above and as a result of the expansion of the gases in the restricted passage. The very low temperature prevailing in the area where the restricted passage connecting the cold ends of the regenerators is situated may be put to use by any suitable means, such as by conduction, through a block of copper forming a cold source, to which the part or test piece to be cooled is attached.

Under conditions of continuous operation, the mean temperature of the regenerators steadies at a constant level whereas the instantaneous temperature is subject to variation in step with the evaporation phases, when a cooling effect is produced, and the condensation phases, when heat energy is released.

It follows from what is said above that the temperature of the cold source is determined by an equation involving both the cooling effect of evaporation and the heat energy from condensation. All other things being equal, the temperature of the cold source is thus fixed and truly constant only if the extent of the cooling effect and the amount of heat energy are themselves fixed and accurately reproducible. However, these two factors are directly related to the quantities of gas fed in or extracted and it has been found that the normal way of controlling the periodic changeovers, where simple timers are used which fix the infeed and withdrawal periods once and for all, is totally unsuited to achieving a genuinely constant temperature in the cold source. There are very probably various explanations for this phenomenon; on the one hand, a simple discrepancy, even a small one, in the lengths of the infeed and withdrawal periods has a very considerable effect on the balance previously arrived at. On the other hand, even if the lengths of the infeed and withdrawal periods were absolutely unchanging and were reproduced with absolute fidelity, all the causes of variations in the temperature of the cold source would still not be removed since differences in the amounts of gas fed in and withdrawn could result simply from slip in the cooler and compressor assembly when operating. At first sight, the most radical solution would appear to be to regulate the temperature of the cold source as a function of the factors which determine it, for example by regulating the duration of an infeed or withdrawal phase in response to minimal divergences on the part of the temperature of the cold source from a reference temperature. However, this is scarcely a simple procedure since the chain of regulation would then have to take into account thermal conditions along the whole length of the regenerators from their cold ends to their hot ends. In fact, it would be advisable to regulate the temperatures at different garduated points along the regenerators, but this would clearly result in the regulating means being almost impossibly complex. Another solution which has been envisaged is to examine the composition of the mixture which is being fed in. In effect, in the course of a cycle involving the fractionated evaporation of a gaseous mixture at least part of which has previously been condensed in a regenerator and which is extracted from this regenerator in order to be fed into the other regenerator, the composition of the mixture varies greatly between the beginning of the infeed phase, when the most volatile substances are present, and the end of the infeed phase when, by contrast, the heaviest substances are present. It was therefore considered that the valves might be changed over when the composition of the infed gaseous mixture reached a characteristic state indicating the end of infeed, which would thus be perfectly reproducible. However, although highly attractive a first sight, this solution cannot be recommended in practice since it requires the continuous use of an especially complex and expensive gas analyser.

SUMMARY OF THE INVENTION

Only after long and careful consideration of all these methods did the present applicants arrive at a particularly simple and effective solution which allows the temperature of the cold source to be satisfactorily regulated. In accordance with the invention, the changeover valves are brought into action as soon as the pressure of the infed gas reaches a reference value. Experience has in fact shown that the rise in pressure, which is virtually uniform from the outlet of the compressor to the cold end of the regenerator being supplied, is the simplest and most accurate indication of the amount of gas which has been fed in and thus of the amounts of heat and cold generated. The control pressure in question is advantageously measured at any point between the outlet of the compressor and the high pressure inlet side of the changeover valves, but the most suitable point is close to the changeover valves, in order to eliminate transient fluctuations which might arise in the immediate neighbourhood of the compressor. The pressure rise is faithfully reproduced at each changeover and by allowing it to continue until the fixed reference pressure is reached, it is ensured that the operating phases of the regenerators will be perfectly reproducible from the thermal and cooling point of view as time progresses and as a result the cyclic variation in thermal conditions in the regenerators is always indentically reproduced, which means that the temperature of the cold source may be held at a specific fixed temperature without in any way drifting with time.

BRIEF DESCRIPTION OF THE DRAWINGS

The features and advantages of the invention will become apparent from the following description, which is given by way of example with reference to the accompanying drawings, in which.

DESCRIPTION OF THE PREFERRED EMBODIMENT

Figure 1:
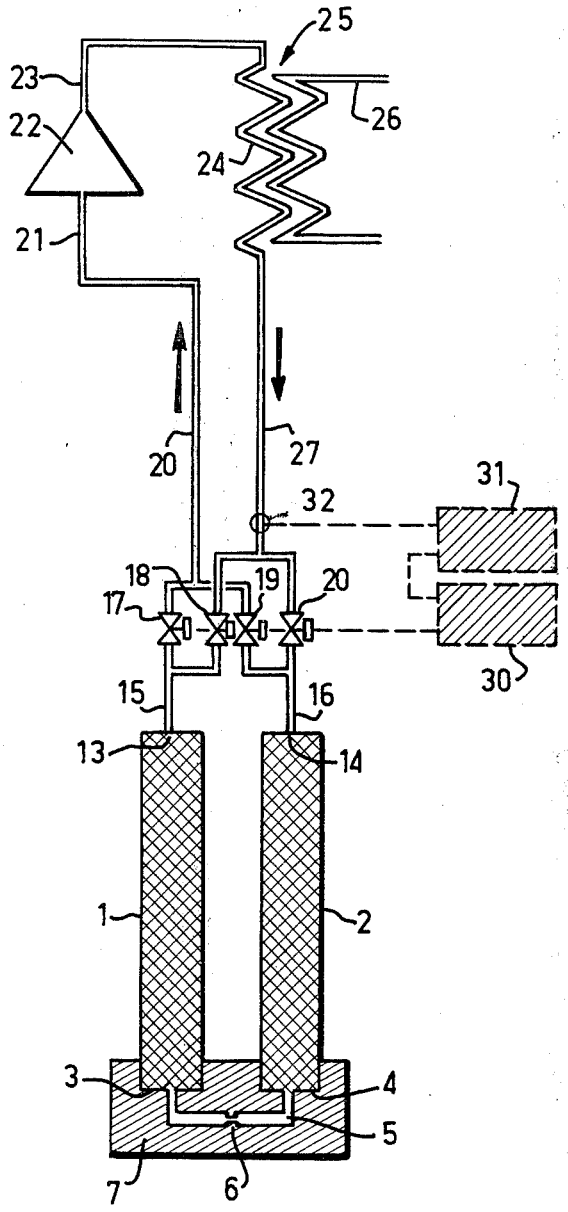
FIG. 1 is a schematic view of an installation for generating low temperatures which employs the method according to the invention.

Referring to the accompanying drawings, an apparatus for generating low temperatures contains two regenerators 1 and 2 whose cold ends 3 and 4 are connected together by a passage 5 which has a calibrated constriction 6, the cold ends and the passage being built into a block of copper 7 which forms the cold source. In the region of their hot ends 13 and 14, regenerators 1 and 2 are connected respectively by lines 15 and 16 to, in the case of line 15 a pair of valves 17 and 18, and in the case of line 16 a pair of valves 19 and 20. Valves 17 and 19 are connected at the other end by a line 20 to an inlet 21 of a compressor 22 of which an outlet 23 is connected to a coil 24 in an exchanger 25. To a coil 26 of exchanger 25 is supplied an external cooling fluid at water temperature for example. Coil 24 of exchanger 25 is connected by a line 27 to the other ends of valves 18 and 20. Valves 17, 18, 19 and 20 are operationally associated in such a way that when one 17 (or 18) of the pair of valves 17 and 18 for example, is open, the other 18 (or 17) is closed. The same applies to valves 19 and 20, but when valve 17 is open valve 20 is open also. Similarly, when valve 18 is open valve 19 is open too. This arrangement allows the input 21 and the output 23 of the compressor 22 to be connected first to hot ends 13 and 14 respectively of regenerators 1 and 2, and then subsequently to ends 14 and 13 respectively of the same regenerators.

Into the closed circuit described above is introduced composite gaseous charge consisting of a certain number of hydrocarbons having different condensation points which if need be, also contains a certain proportion of nitrogen. There is thus produced an apparatus for generating low temperatures which operates as follows:

If the changeover valve arrangement 17, 18, 19, 20 is in a position such that valves 17 and 20 are open, it can be seen that regenerator 1 will be connected to the suction side 21 of compressor 22, whilst regenerator 2 will be connected to the delivery or high-pressure side 23 of compressor 22. The result is that the gaseous charge, at least part of which is originally in regenerator 1, is fed under pressure to regenerator 2, where part of it condenses in stages from the hot end 14 to the cold end 4.

At least part of the residue of gases which will not condense at the temperature prevailing at the cold end 4 of regenerator 2 makes its way to regenerator 1 through passage 5 and the calibrated orifice 6. Downstream of the calibrated orifice 6, and in particular within the body of regenerator 1, these gases progressively take the place of the gases of the gaseous charge which are currently evaporating as a result of the low pressure caused by the suction from compressor 22.

After a certain period of time, the valve arrangement (17, 18, 19, 20) is changed over and valves 18 and 19 are then the only ones open, with the result that generator 2, which was originally at high pressure and contained the at least partly condensed gases during the in-feed phase, is subjected to the suction from compressor 22, whilst regenerator 1, which was formerly at low pressure is progressively pressurised as a result of the transfer by compressor 22 of the gases which evaporate in generator 2. During this phase the gases are fed into regenerator 1, where they condense in a graduated fashion, while the products of condensation in generator 2 evaporate progressively from the most volatile to the heaviest.

In accordance with the invention, the changeover valves (17, 18, 19, 20) are operated by a control device 30 which is in turn controlled by a device 31 which acts in response to a signal supplied by a pressure sensor 32. Pressure sensor 32 is inserted in the line 27 which connects the output of compressor 23 to the high-pressure input of valves 18 and 20.

Figure 2:
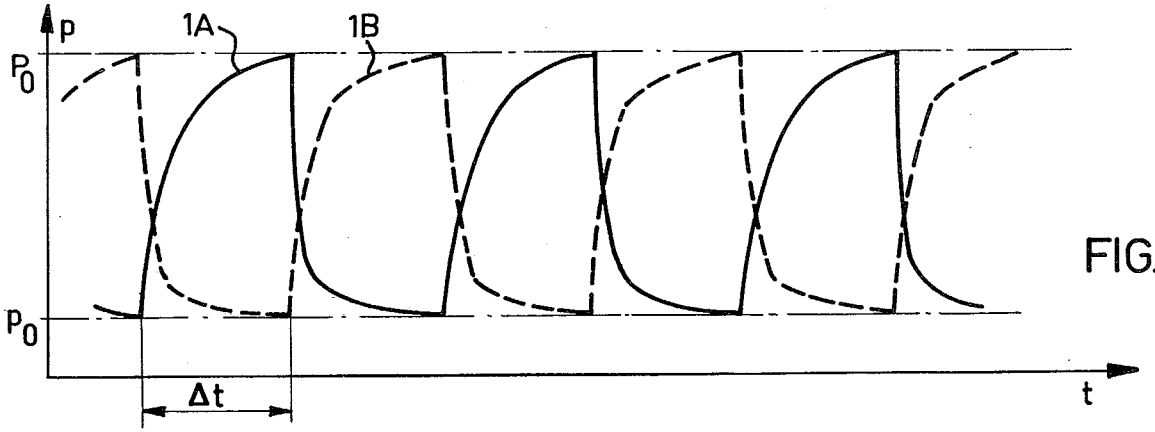
FIGS. 2 and 3 are graphs showing pressure as a function of time, on the one hand in the two regenerators and on the other hand at the outlet from the compressor.
Figure 3:
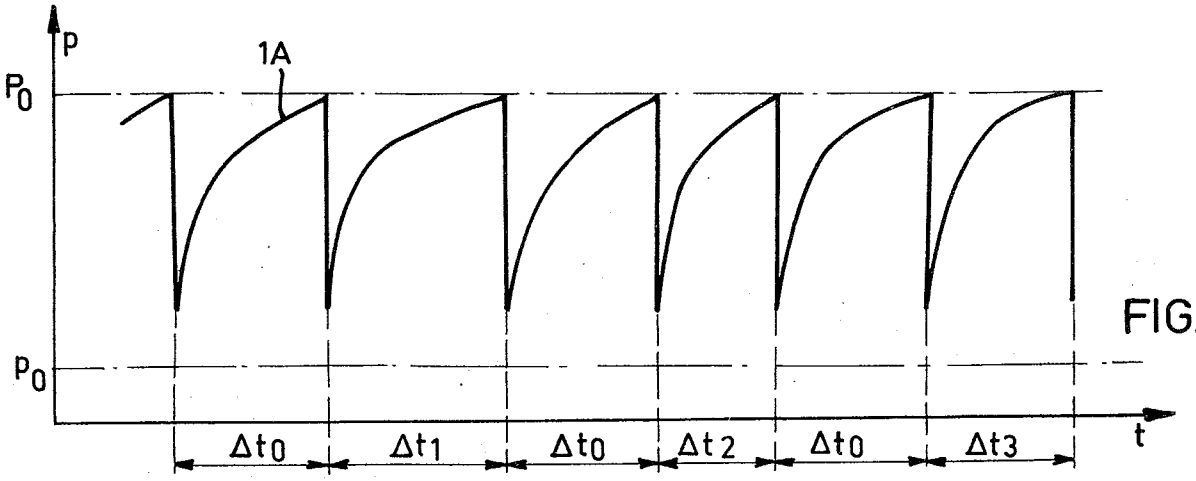

Referring to FIG. 2, there can be seen the changes in pressure $p$ in regenerators 1 (curve 1A) and 2 (curve 1B) as a function of time $t$, and in FIG. 3 can be seen the change in pressure at the input, that is to say the point where sensor 32 is situated, to the changeover valves (17, 18, 19, 20), as a function of time $t$. It will be appreciated that if pressure at point 32 is measured, then when it reaches a selected value Po, it is possible for the valves (17, 18, 19, 20) to be changed over via device 30, without paying any heed to the exact time taken by the pressure in the cold generating apparatus to rise from the minimum Po to the maximum Po.

This being the case, the mean period between changeovers may vary considerably as a function of fluctuations in the temperature of the regenerators. To avoid such variations, which might detract from the satisfactory operation of the regenerators, it is necessary to ensure a constant mean period between changeovers. There are various possible ways of achieving this which may be considered. Below are described a number of ways of arriving at a suitable period between changeovers:

Continuously monitoring the mean period between changeovers (by means of an electronic computer for example) and varying the reference pressure Po to hold this mean period at the correct value;

Measuring the period between changeovers periodically (once every $n$ changeovers) and acting on Po to adjust the length of the period:

Changing over after a period of fixed length every other time, with the pressure Po which is reached at the end of this fixed period acting as a reference for the next period between changeovers, which will be a "variable duration" period.

Figure 4:
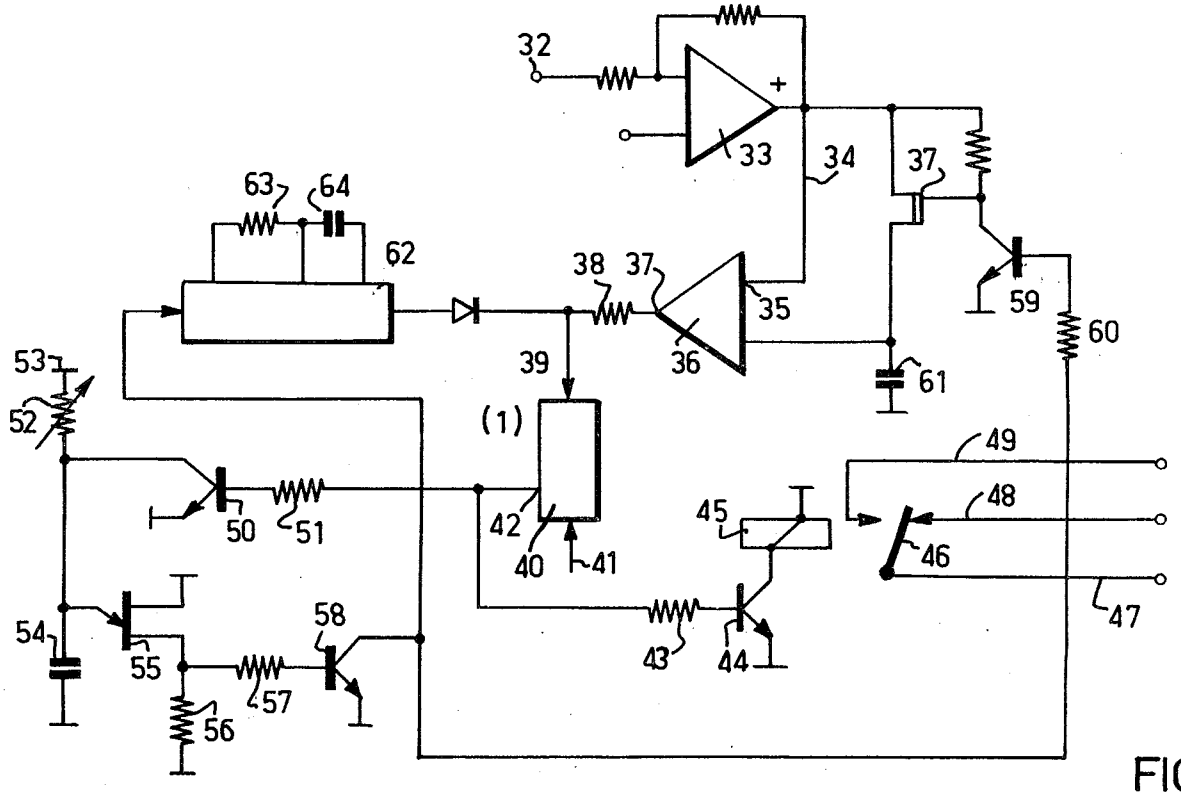
FIG. 4 is a simplified diagram of a regulating device which allows the method according to the invention to be put into effect.

The regulating device which is used will be described by way of example with reference to FIG. 4.

It consists of the sensor 32 situated in the high pressure line 27 upstream of valves 18 and 20. This sensor 32 is a pressure-sensitive electrical component and is situated at the input to a signal amplifier 33 whose output is fed on the one hand directly at 34 to an input 35 of a comparison amplifier 36, and on the other hand via a switching transistor 37 to another input 38 of comparison amplifier 36. There is also a storage capacitor 61 connected to the second input of comparison amplifier 36. Comparison amplifier 36 has an output 37 which is connected by a resistor 38 to an input 39 of a bistable flip-flop 40 which has a second control input 41. An output o42 of bistable flip-flop 40 is connected via a resistor 43 to an amplifying transistor 44 in the energising circuit of a relay 45 whose movable contact 46, which is supplied at 47, may be electrically connected either to a conductor 48 which allows electrical valves 17 and 19 to be excited, or to a conductor 49 which allows electrical valves 18 and 20 to be excited, or vice versa.

The output of bistable flip-flop 40 is also electrically connected to a transistor 50, via a resistor 51, transistor 50 being connected to the output of a variable resistor 52 which is itself connected between an electrical source 53 and earth via a capacitor 54 termed the "fixed duration" capacitor. The common point of resistor 52 and the "fixed duration" capacitor 54 is connected via a triggering transistor 55 to the common point of a resistive divider 56, 57. One end of the latter is connected by a shaping transistor 58 to an amplifying transistor 59, via a resistor 60, and from there to the input of the switching transistor 37 described above.

A second take-off from the output of shaping transistor 58 is connected to a monostable flip-flop 62 which supplies to amplifier 36 an inhibiting signal whose length is controlled by the time-base formed by resistor 63 and capacitor 64.

The manner in which the arrangement operates is as follows. It can be broken down into two clearly distinguishable phases, namely:

a. With bistable flip-flop 40 in the 1 state (a control pulse via 39), its output 42 delivers a "low" electrical signal. Transistor 50 is deprived of its electrical supply through resistor 51 and goes to the open state. Capacitor 54 therefore has a supply through adjustable resistor 52 and the voltage at its terminals rises progressively. At the end of a certain period, which depends solely on the value (which is in any case adjustable) of resistor 52 and the capacity of capacitor 54, the voltage at the terminals of capacitor 54 reaches the triggering voltage of transistor 55. The result is a sudden rise in the voltage at the common point of resistors 56 and 57, followed by an exponential drop. Via resistor 57, the pulse so formed actuates shaping transistor 58, the collector of which generates a "low" level pulse which marks the end of the "fixed duration" phase and immediately causes the following to take place:

Firstly, the field effect switching transistor 37 to be made conductive via resistor 60 and transistor 59. In consequence, the positive voltage at the output of amplifier 33, which is proportional to the pressure at point 32, is transmitted for storage to storage capacitor 61;

Secondly, by means of a circuit which is not described, the signal supplied by transistor 58 causes bistable flip-flop 40 to change to the 0 state by acting on input 41 and thus, via transistor 44 and relay 45, causes contact 46 to move from conductor 48 to conductor 49, thus bringing about the changeover between valves 17, 19 and valves 18, 20;

Finally, transistor 58 causes monostable flip-flop 62 to trigger; the duration of the output signal from this flip-flop being proportional to the value of resistor 63 and the capacity of capacitor 64. The signal emitted by monostable flip-flop 62 inhibits any action which comparison amplifier 36 might try to exert on input 39 of bistable flip-flop 40 while waiting for the pressure to drop back to its minimum value.

b. The beginning of the "variable duration" phase has now been reached:

In the course of this phase, comparison amplifier 36 continuously compares the voltage at capacitor 61, which represents the level of voltage which had been stored at the end of the "fixed duration" phase, with the voltage at the output of amplifier 33, which represents the actual instantaneous pressure level measured during this second phase. When the voltage at the output of amplifier 33 reaches the same level as the voltage stored in capacitor 61, comparison amplifier 36 gives a signal which returns bistable flip-flop 40 to the 1 position so doing via resistor 38. At this moment a pulse is of course generated in the circuit consisting of resistor 43 and transistor 44, and this pulse causes contact 46 of relay 45 to change from position 49 to position 48 and to return the changeover valves (17, 18, 19, 20) to the position in which they were at the beginning of the "fixed duration" phase.

It will be appreciated that in this second phase it has been possible to generate the same amount of cold as in the previous phase even though the duration of the second phase may be greater ($\Delta t1$), smaller ($\Delta t2$) or even the same as ($\Delta t3$) the duration of the first phase ($\Delta to$), as FIG. 3 demonstrates.

The invention is chiefly applicable to regulating the operation of cooling effect generators of the type which have coupled regenerators and a composite gaseous charge.

We claim:

1. A method of generating low temperatures, which involves the use of a composite gaseous charge made up of gases such as hydrocarbons and nitrogen having graduated condensation temperatures, which charge is placed in a closed circuit which includes a pair of thermal regenerators which are connected together at cold ends by a passage containing a restricted opening and which are connected at their hot ends to a compressor and a cooler assembly via changeover valves, in which method the changeover valves are operated cyclically in such a way that, periodically, in a first phase the gases forming the said composite gaseous charge are extracted from one regenerator and fed into the other regenerator, and then the reverse is done in a second phase, and so on, and in which the changeover valves are operated as soon as the pressure of the infed gas reaches a reference value.

2. A method for generating low temperatures according to claim 1, wherein the operation of the changeover valves is subject to the pressure of the infed gas being equal to a reference pressure in only a limited number of operating phases termed "variable duration" phases, and the reference pressure is that reached at the end of the other operating phases, termed "fixed duration" phases, the duration of which is fixed beforehand.

3. A method of generating low temperatures according to claim 2, wherein the variable duration operating phases, in which the changeover of the valves is subject to a reference pressure being reached, are in all cases phases which follow a fixed duration operating phase, and in that the reference pressure for a variable duration phase is that reached at the end of the fixed duration phase which precedes it.

4. A method of generating low temperatures according to claim 1, wherein the mean period between changeovers of the changeover valves is regulated about a set value, for example by continuous monitoring by an electronic computer which allows the reference pressure to be adjusted, by periodically measuring the period between changeovers and by adjusting the reference pressure, by employing a first fixed duration period between changeovers which is used to set the reference pressure.

5. Apparatus for generating low temperatures, of the kind which has a closed circuit receiving a composite gaseous charge made up of gases, such as hydrocarbons and nitrogen, having graduated condensation temperatures, which circuit includes a pair of thermal regenerators which are connected together at their cold ends by a passage containing a constricted opening and which are connected at their hot ends to a compressor and cooler assembly via changeover valves which enable one of the regenerators to be connected to the suction side of the said compressor and the other to the delivery side of the said compressor and then vice versa, and so on, wherein the means for controlling the changeover valves include means which are subject to obtaining a pressure equal to a reference pressure in the infeed line.

6. Apparatus for generating low temperatures according to claim 5, wherein the means for controlling the changeover valves include means responsive to a duration of time, which time may, if required, be adjustable.

7. Apparatus for generating low temperatures according to claim 6, wherein the means for controlling the changeover valves which are subject to the reference pressure are brought into action each time the duration responsive means are brought into action, but subsequently thereto, and wherein the reference pressure is that which is stored when the duration responsive means have finished operating, which occurs before the means subject to the said reference pressure are brought into action.

8. Apparatus for generating low temperatures according to claim 6, wherein the duration responsive control means include a resistance/capacitance circuit in which the voltage at the terminals of the capacitor is connected to a terminal of a changeover flip-flop and a capacitor for storing the final pressure reached.

9. Apparatus for generating low temperatures according to claim 7, wherein the control means subject to the reference pressure include a comparator for comparing actual voltage and the voltage at the storage capacitor, the output of the said comparator being connected to the other terminal of the changeover flip-flop.

* * * * *